US011261007B1

(12) United States Patent
Lee

(10) Patent No.: US 11,261,007 B1
(45) **Date of Patent: *Mar. 1, 2022**

(54) HANDLE ASSEMBLY FOR MOVABLE CONTAINER

(71) Applicant: San Fu Lee, Tampa, FL (US)

(72) Inventor: San Fu Lee, Tampa, FL (US)

( * ) Notice: Subject to any disclaimer, the term of this patent is extended or adjusted under 35 U.S.C. 154(b) by 121 days.

This patent is subject to a terminal disclaimer.

(21) Appl. No.: 16/779,057

(22) Filed: Jan. 31, 2020

Related U.S. Application Data

(63) Continuation of application No. 16/000,988, filed on Jun. 6, 2018, now Pat. No. 10,730,666.

(51) Int. Cl.

| | |
|---|---|
| ***B65D 25/34*** | (2006.01) |
| ***B65D 25/32*** | (2006.01) |
| ***B65D 25/28*** | (2006.01) |
| *B65D 8/00* | (2006.01) |
| *B65D 1/16* | (2006.01) |

(52) U.S. Cl.
CPC ..... *B65D 25/32* (2013.01); *B65D 25/2885* (2013.01); *B65D 25/2888* (2013.01); *B65D 1/16* (2013.01); *B65D 7/04* (2013.01)

(58) Field of Classification Search
CPC ..... B65D 25/32; B65D 25/2885; B65D 25/2882; B65D 25/2888; B65D 25/28; B65D 25/2802; B65D 25/2835; B65D 25/287; B65D 1/16; B65D 7/04
USPC .... 220/775, 776, 756, 212.5, 752, 772, 773, 220/760, 17.2, 754, 757
See application file for complete search history.

(56) References Cited

U.S. PATENT DOCUMENTS 1,417,827 A * 5/1922 Hawley ..... B65D 45/28 217/89
2003/0116577 A1* 6/2003 Slongo ..... B65D 25/22 220/755

FOREIGN PATENT DOCUMENTS

FR 2082903 * 12/1971 ..... B65D 25/28

* cited by examiner

*Primary Examiner* — Don M Anderson
*Assistant Examiner* — Elizabeth J Volz
(74) *Attorney, Agent, or Firm* — Smith & Hopen, P.A.; Paul Murty

(57) ABSTRACT

A container including a rigid base and one or more rigid lateral walls, the lateral wall being perimetrically continuous, such that the lateral wall and the base define a cavity. The cavity allows for the storage and transportation of contents, such as sand, rocks, building materials, paints, and other liquids. The container includes a set of flanges on an exterior side of the one or more lateral walls, with the flanges providing attachment points for a set of handles. When the set of handles are secured to the flanges, a user can easily grip the handles to transport the container to a new location. In addition, the container includes a circumferential lip that extends below the base, such that a user can easily grasp the lip at different locations to maneuver the container, without forcing the user to grip a specific handle on the bottom of the container.

15 Claims, 10 Drawing Sheets

HANDLE ASSEMBLY FOR MOVABLE CONTAINER

CROSS-REFERENCE TO RELATED APPLICATIONS

This nonprovisional application is a continuation of and claims priority to nonprovisional application Ser. No. 16/000,988, entitled "Handle assembly for movable container," filed on Jun. 6, 2018 by the same inventor.

BACKGROUND OF THE INVENTION

1. Field of the Invention

This invention relates, generally, to handle assemblies for movable containers. More specifically, it relates to a handle assembly including a set of flanges adapted to extend from a container including a bottom lip, thereby allowing a user to easily grip and move the container, as well as dispose of the container's contents.

2. Brief Description of the Prior Art

While containers are often used to transport contents between locations, the physical act of transporting most containers proves difficult for users. In particular, containers that house materials used in construction and home improvement applications can be difficult to transport by hand, both due to the weight of the contents and the lack of comfortable handles on the containers. For example, a can of paint typically includes a single handle pivotably attached at two opposing locations on the can. The handle provides a means for a user to grip and transport the can; however, due to the attachment mechanism of the handle, the user must grip the handle at the center of mass, thereby experiencing the full weight of the can on one arm. The user could instead use two hands on the singular handle; however, such an arrangement is awkward and limits the user's mobility, which is especially detrimental during construction and home improvement applications. Larger containers, such as five-gallon buckets, include similar issues, with some users being incapable of transporting the five-gallon buckets when they are filled with materials, due to the center of mass and the discomfort experienced while gripping the handle.

In addition, the containers discussed above include another difficulty-disposal of the contents housed within the containers. Often, users must pour or otherwise empty the containers of contents, which can be liquid (i.e., paint, water, cement) or solid (topsoil, rocks, sand). With traditional containers, a user must grip the singular handle and attempt to grip a portion of the container. Because the container does not include a series of handle-points, it is difficult for the user to maneuver the container while emptying its contents. Moreover, it is difficult for the user to control the emptying of contents from the container, often leading to over-emptying of contents. If the contents are topsoil or sand, such over-emptying adds to the workload of the user, making the task harder and more time-consuming.

Efforts have been made to provide handles for movable containers in attempts to solve the problems discussed above. U.S. Pat. No. 4,927,046 to Armstrong teaches a supportive handle disposed on the body of a container, allowing a user to grip the container via the supportive handle. However, the supportive handle suffers from the same drawbacks as traditional handles—the user experienced the center of mass in one arm, making it difficult to transport the container between locations. In addition, because the supportive handle is fixed at a location by being built into the container body, the user must grip the handle to empty the contents of the container. As such, the user cannot simply grab the container to empty it—the user must grab a particular part of the container, the supportive handle.

Similarly, U.S. Pat. No. 9,669,959 to Luburic teaches a container having an integrated set of handles. The container includes handles at the upper portion of the container, as well as at least one handle built into one of the sidewalls of the container adjacent to the bottom portion. As such, the handles are designed to help a user transport the container, as well as dispose of the contents thereof. However, similar to the '046 Patent above, the '959 Patent forces a user to grip certain portions of the container, because the bottom handle is built into one of the sidewalls. In addition, the bottom handle could weaken the structure of the container, such that the container walls could warp and break about the bottom handle. The same drawbacks are experienced with the container taught in U.S. Pat. No. 9,856,052 to O'Leary et al.

Accordingly, what is needed is a handle assembly for a movable container that allows a user to easily and comfortably grip different portions of the container to transport and empty the contents thereof. However, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for a container having a comfortable and ergonomic upper handle assembly and a bottom lip forming a handle, allowing a user to easily and comfortably transport and empty a container, is now met by a new, useful, and nonobvious invention.

The novel container includes a rigid lateral wall having a top end opposite a bottom end, and a rigid base disposed between the top and bottom ends. The lateral wall is perimetrically continuous, such that the lateral wall and the base define a cavity. In an embodiment, the container is cylindrical in shape, and the lateral wall is a lateral circumferential wall. In addition, the container includes a circumferential lip at extends at least 1.5 inches below the base, such that a user may easily grasp the lip in different locations to maneuver the container, allowing the user to overturn and empty the container of its contents.

A pair of flanges are diametrically disposed on the container, with the flanges being disposed proximate to the top end of the lateral wall. Each flange includes a first end opposite a second end, with a body disposed therebetween. A first lateral aperture is disposed within the first end, and a second lateral aperture is disposed within the second end. In addition, a superior aperture is disposed within an upper portion of the body. The apertures provide attachment points for handles to be inserted and secured therein. For each flange, a distance between the superior aperture and the lateral wall is less than a distance between the lateral apertures and the lateral wall.

A pair of handles are secured to the pair of flanges, allowing a user to pick up and transport the container. Each handle has a first portion opposite a second portion, with a body disposed therebetween, the body being grippable by a user. Each end of the pair of handles is insertable within one of the lateral apertures of one of the flanges. The first and second portions of each handle include a free end, with the free ends being insertable within one or more of the apertures disposed within the first and second flanges. In an embodiment, an overhanging flange is disposed at a terminal portion of each free end. The overhanging flange has a diameter greater than a diameter of the free end and greater than a diameter of the lateral apertures. As such, the overhanging flanges prevent removal of the first and second handles from the lateral apertures.

A third handle including a first end opposite a second end, with a body disposed therebetween, is securable within the superior apertures of the flanges. The third handle is flexible, and may span across a diameter of the container. Since the superior apertures are closer to the lateral wall than the lateral apertures are to the lateral wall, the third handle does not interfere with the first and second handles secured within the lateral apertures. The third handle may include an end cap secured to at least one of the first and second ends, with the end cap adapted to be inserted within the at least one superior aperture and prevent removal of the third handle from the at least one superior aperture.

In an embodiment in which the container is a cylinder having a lateral circumferential wall, an annular member is removably couplable to the lateral circumferential wall. As such, the annular member has a diameter that is greater than a diameter of the cylindrical container, allowing the annular member to form a friction fit with the container. The at least one flange is disposed on the annular member, allowing the flange to be removably coupled to the container as well. The annular member allows flanges and handles to be retrofit onto existing containers.

An object of the invention is to facilitate the transportation of a container between locations, as well as the emptying the contents of the container, by providing different handles on a container. For example, a set of handles on an upper portion of the container facilitates transportation by allowing the user to securely grip a set of handles, as opposed to a single handle, thereby displacing the weight of the container across both handles. Additionally, a lip on a lower portion of the container enables a user to grip different locations on the container, allowing a user to easily overturn and empty the container.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a container including a base and one or more lateral walls that define a cavity therein. Contents, such as sand, rocks, building materials, paints, and other liquids can be stored within the cavity of the container and transported between locations by a user. To aid in the transportation of the contents, the container includes a set of flanges on an exterior side of the one or more lateral walls. The flanges provide an attachment point for a set of handles couplable thereto. When the set of handles are secured to the flanges, a user can easily grip the handles to transport the container to a new location. In addition, a lower portion of the one or more lateral walls extends beyond the base, thereby forming a lip disposed on the container. A user can grip the lip to aid in emptying the container of its contents, without forcing the user to grip a specific handle on the bottom of the container.

Figure 1A:
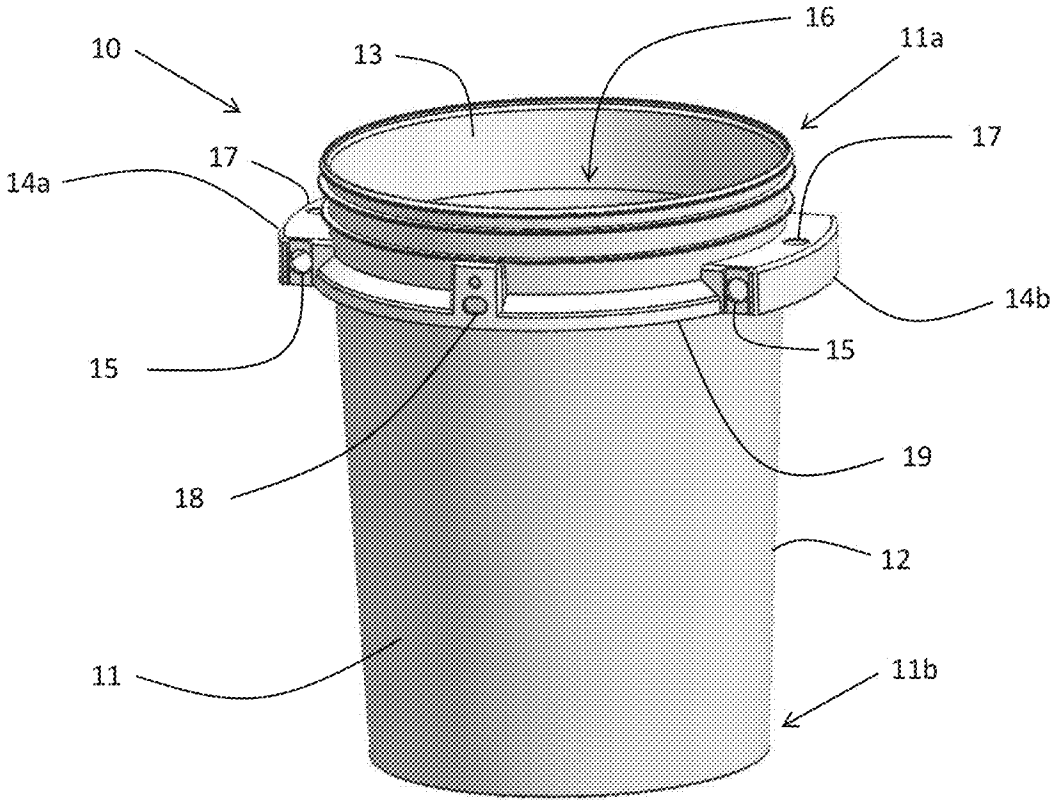
FIG. 1A is an orthogonal view of a container including a set of flanges.

As shown in FIG. 1A, container 10 includes rigid lateral wall 11, including top end 11*a* opposite bottom end 11*b*, as well as exterior surface 12 and interior surface 13. While container 10 is shown in FIG. 1 to be a cylindrical bucket having a single lateral wall 11 that is a lateral circumferential wall, it is understood that container 10 could be polygonal, including more than one lateral wall, such as a rectangular storage container have four lateral walls. As FIG. 1 shows, lateral wall 11 is perimetrically continuous; as such, together with a base (described in greater detail below), lateral wall 11 defines cavity 16 of container 10. Cavity 16 is a space within container 10 into which materials may be displaced for convenient transportation and storage.

Due to the problems discussed above in transporting containers between locations, container 10 includes flanges 14*a*, 14*b* disposed proximate to top end 11*a* of container 10. Each of flanges 14*a*, 14*b* provides one or more attachment points for handles, which are discussed in greater detail below. FIG. 1 depicts two different attachment points on flanges 14*a*, 14*b*-lateral aperture 15 on a side portion of flanges 14*a*, 14*b*, and superior aperture 17 on a top portion of flanges 14*a*, 14*b*. Each of lateral aperture 15 and superior aperture 17 are disposed within one or more of flanges 14*a*, 14*b*, providing different attachment points on container 10. A center axis of lateral aperture 15 is tangential to lateral wall 11, and a center axis of superior aperture 17 is perpendicular to that of the center axis of lateral aperture 15. The distance between superior aperture 17 and lateral wall 11 is less than the distance between lateral aperture 15 and lateral wall 11. As such, a handle attached to superior aperture 17 will not interfere with a handle attached to lateral aperture 15, a relationship that will be discussed in greater detail below.

As shown in FIG. 1A, flanges 14*a*, 14*b* are diametrically opposed on container 10, with flanges 14*a*, 14*b* separated by a length equal to the diameter of container 10. Because flanges 14*a*, 14*b* are opposite each other, the flanges provide attachment points for handles that may be comfortably gripped by different hands, allowing a user to transport container 10 without bearing the brunt of the weight of container 10 on one arm. Instead, the mass of container 10 is displaced between flanges 14*a*, 14*b*, improving the user's ability to transport container 10 via handles attached to flanges 14*a*, 14*b*.

Container 10 may include annular member 19 disposed on exterior surface 12 of lateral wall 11, such that annular member 19 has a diameter slightly larger than a diameter of container 10. Annular member 19 indirectly connects flange 14*a* with flange 14*b*, providing additional structure to decrease the likelihood that either of flanges 14*a*, 14*b* will decouple from container 10. In addition, annular member 19 includes an additional attachment point, aperture 18, for the attachment of a handle. Although not shown, another aperture may be disposed opposite aperture 18, separated by the diameter of annular member 19. The handle attached to aperture 18 will be described in greater detail below. Annular member 19 is shown formed integrally with container 10; however, it is appreciated that annular member 19 may be couplable with container 10, such through a friction fit relationship, a bolt or screw directly coupling annular member with container 10, a clamping relationship, or other known mechanical fasteners.

Figure 1B:
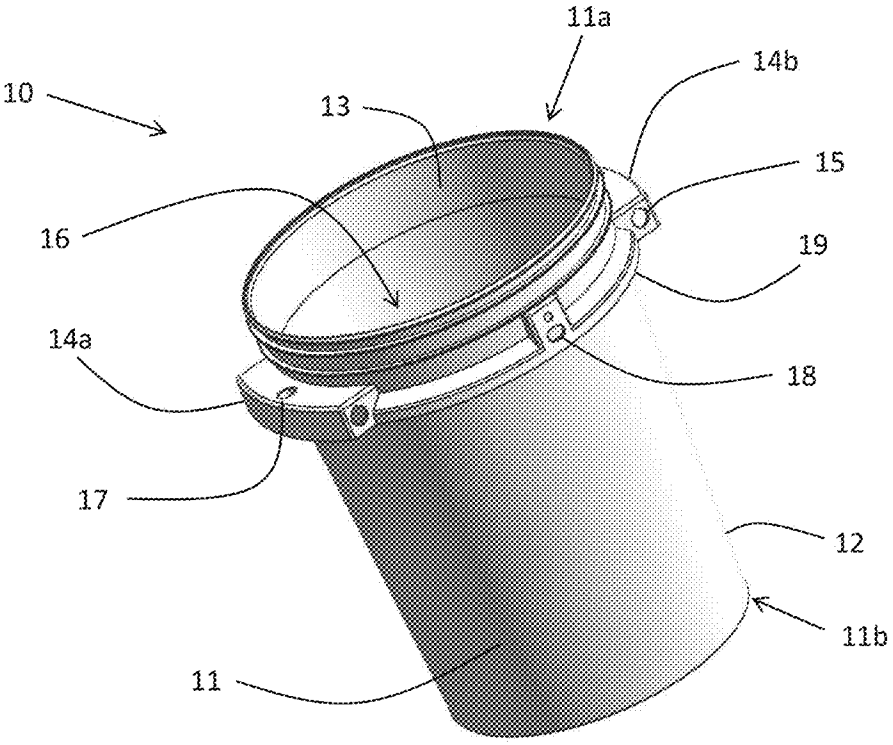
FIG. 1B is a perspective view of the container of FIG. 1A.
Figure 2:
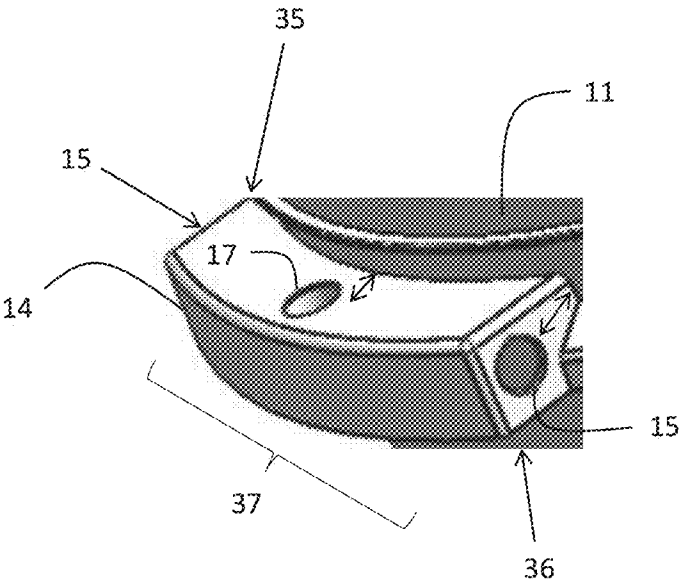
FIG. 2 is a perspective close-up view of one of the flanges of FIG. 1.

As shown in FIG. 1B, flange 14*a* includes superior aperture 17, and that flange 14*b* includes lateral aperture 15-FIG. 1A depicted superior aperture 17 on flange 14*b*, and lateral aperture 15 on flange 14*a*. Accordingly, FIGS. 1A and 1B together show that each of flanges 14*a* and 14*b* include superior aperture 17 and at least one lateral aperture 15. In addition, FIG. 2 shows the relationship between lateral aperture 15 and superior aperture 17 in greater detail. Specifically, superior aperture 17 is closer to lateral wall 11 than lateral aperture 15 is to lateral wall 11.

FIG. 2 shows one of flanges 14*a*, 14*b* in greater detail, with the flange being generally depicted as reference numeral 14. Flange 14 includes first end 35 opposite second end 36, with body 37 disposed therebetween. First lateral aperture 15 is disposed within first end 35 (not explicitly shown in FIG. 2), and second lateral aperture 15 is disposed within second end 36. In addition, superior aperture 17 is disposed within an upper portion of body 37.

As shown in FIG. 2 and as discussed above, the distance between superior aperture 17 and lateral wall 11 is less than the distance between either of lateral apertures 15 and lateral wall 11. As such, a handle that is secured through superior aperture 17 is closer to lateral wall than is a handle secured through lateral aperture 15. The placement of superior apertures 17 and of lateral apertures 15 thereby allows, for example, a rope handle spanning between diametrically opposed superior apertures 17 to be disposed between container 10 and a handle secured within lateral apertures 15. In this configuration, the rope handle will not interfere with the other handles when the rope handle is not in use-instead, the rope handle can hang between container 10 and the other handles, allowing a user to maneuver container 10 without interference.

Figure 3:
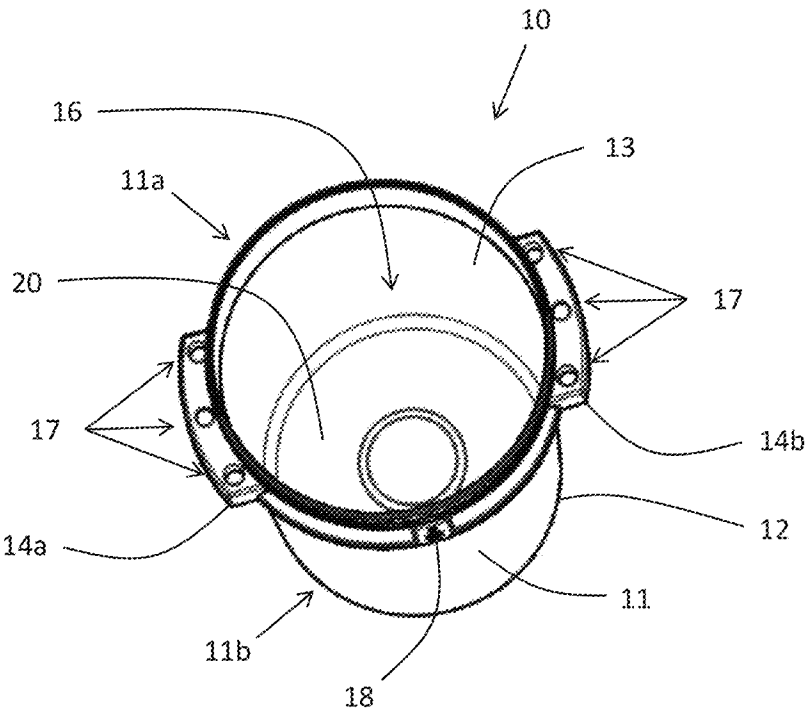
FIG. 3 is a perspective top-side view of the container of FIG. 1, showing the cavity defined by the base and the one or more lateral circumferential walls.

FIG. 3 shows the interior of container 10 in greater detail, in particular the boundaries that define cavity 16. Container 10 includes rigid base 20 disposed therein, with base 20 being substantially perpendicular to lateral wall 11, such that container 10 is a cylinder. Since container 10 does not including an upper wall parallel to base 20, container 10 is open on one side; as such, rigid base 20 and rigid lateral wall 11, being perimetrically continuous, define cavity 16. Also shown in FIG. 3 are a plurality of superior apertures 17 disposed on each of flange 14*a* and 14*b*, with the outer superior apertures 17 being disposed further away from lateral wall 11 than the distance between the central superior aperture 17 and lateral wall 11. The plurality of superior apertures 17 depicted in FIG. 3 provide multiple attachment points for handles to be inserted therethrough, allowing for different orientations of handles to be secured to container 10. For example, handles may be diametrically opposed and secured to container 10, with each handle being secured through the outer superior apertures 17 on one of flanges 14*a*, 14*b*. Such a pair of handles could be used in conjunction with the bail-like rope handle discussed in the previous paragraph, or the pair of handles could be used independently of another handle.

Figure 4:
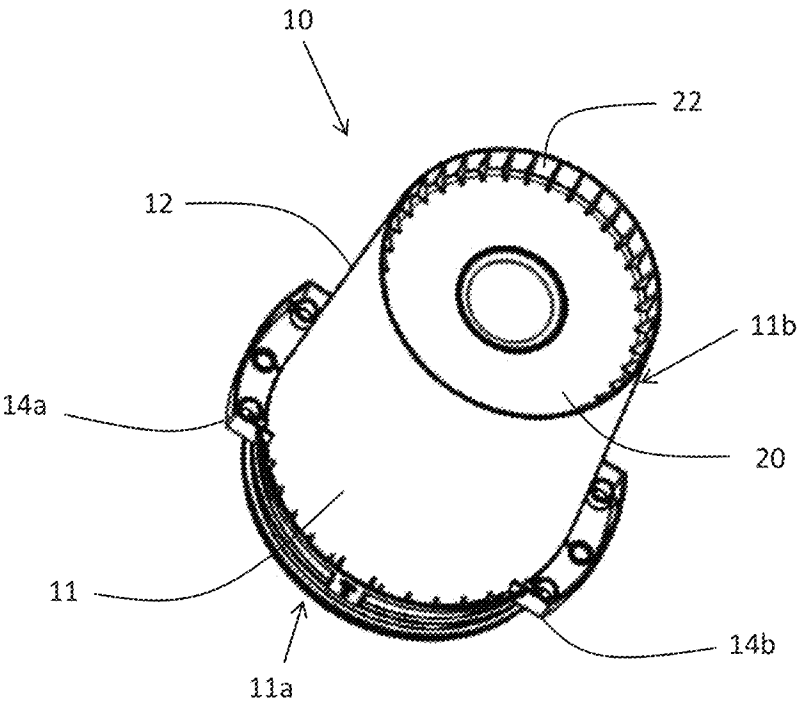
FIG. 4 is a perspective bottom-side view of the container of FIG. 1, showing the circumferential lip that extends below the base.

Turning now to FIG. 4, container 10 includes lip 22, which functions as a handle below base 20. Lip 22 as shown is a circumferential lip that extends below base 20, such that if container 10 rested on a ground surface, a free end of lip 22 would be disposed on the ground surface, rather than base 20. While lip 22 is shown as a portion of lateral wall 11, specifically bottom end 11*b* of lateral wall 11, it is appreciated that lips 22 may be an independent extension below base 20. Importantly, lip 22 provides a lower handle on container 10 for a user that is not tied to one specific location on container 10. As such, lip 22 is circumferentially disposed on container 10, allowing a user to grip different parts of lip 22, without forcing the user to grip a handle built into a specific location of container 10. As such, the user can easily grip a portion of lip 22, such as to overturn container 10 and empty the contents thereof, or to more securely transport container 10 between locations. While it is common for existing buckets to have a lip, those lips are too small to provide a usable and comfortable gripping structure. The present invention overcomes this shortsighted design flaw by having a lip at least 1.5 inches in length to provide an area for a user to easily grip and manipulate container 10. In addition, because lip 22 extends beyond base 20, it is appreciated that a user can flip container 10 upside-down, such that top end 11*a* of lateral wall 11 is disposed on a ground surface, and can use base 20 as a platform to hold materials. In an embodiment, a user utilizes base 20 as a cutting board to clean a fish while fishing, with container 10 capable of functioning as a bait bucket.

Figure 5:
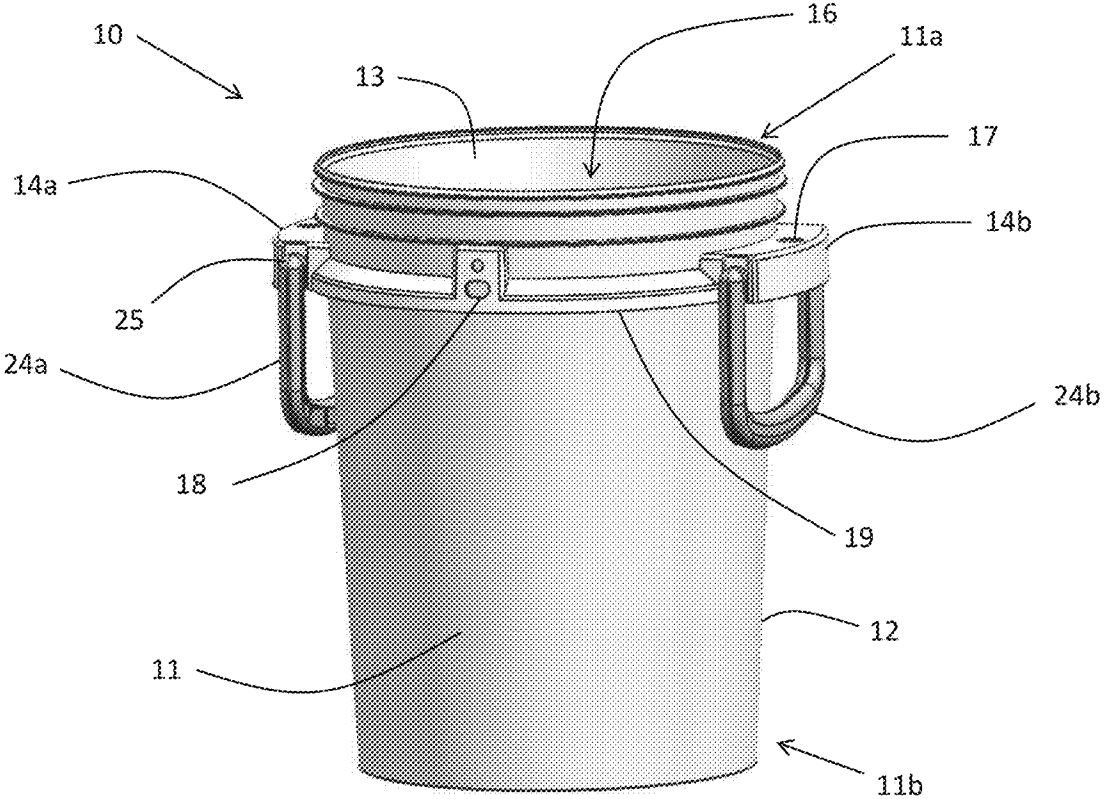
FIG. 5 is an orthogonal view of the container of FIG. 1 including a set of handles secured to the set of flanges.

FIG. 5 shows handles 24*a* and 24*b* coupled to container 10 via flanges 14*a*, 14*b*, respectively. Handles 24*a*, 24*b* may be rigid, such as metal or plastic, or may be flexible, such as rope or nylon. Handles 24*a*, 24*b* are disposed on opposing sides of lateral wall 11, such that a user can grip handle 24*a* with one hand, and handle 24*b* with another hand, thereby allowing the user to transport container 10 via both of handles 24*a*, 24*b*. In the embodiment of FIG. 5, each of handles 24*a*, 24*b* includes one or more coupling member 25 that is insertable within lateral aperture 15 on each of flanges 14*a*, 14*b*.

Figure 6:
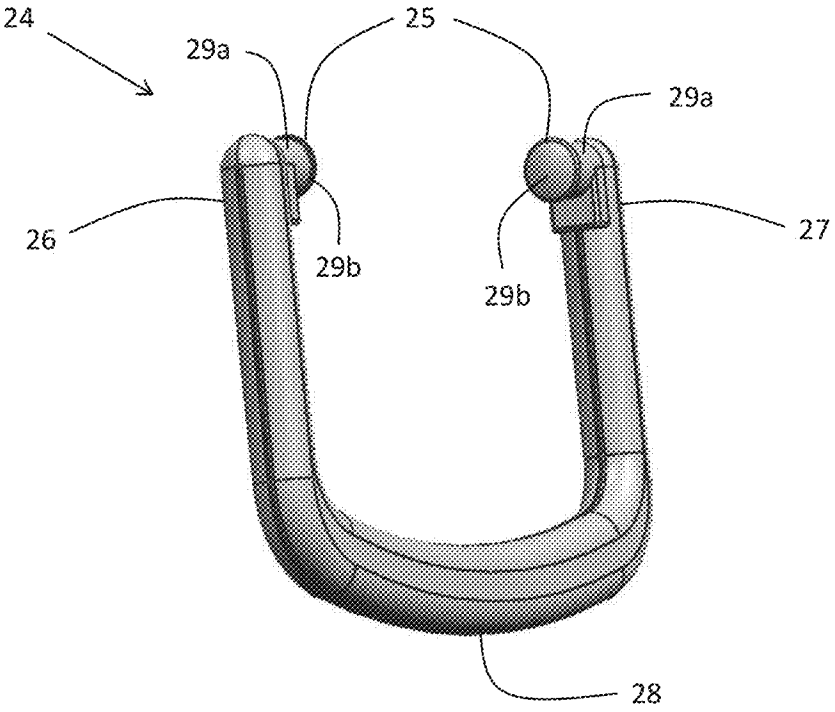
FIG. 6 is a perspective close-up view of one of the handles of FIG. 5.

FIG. 6 is a close-up perspective view of one of handles 24*a*, 24*b* depicted as reference numeral 24. Handle 24 is depicted as being U-shaped, including first portion 26, gripping body 28, and second portion 27, with body being disposed between and indirectly coupling first portion 26 and second portion 27. Each of first portion 26 and second portion 27 includes a coupling member 25 that is a lateral extension of the portion, such that coupling members 25 are substantially perpendicular to the portions. Gripping body 28 forms an angle with each of first and second portions 26, 27, such that gripping body 28 provides a comfortable grasping platform for a user's hand.

As depicted, coupling members 25 are disposed on opposing portions of handle 24, and are perpendicular to first and second portions 26, 27. Each coupling member 25 includes a smooth, curved free end 29*a* with an overhanging flange 29*b*, with curved free end 29*a* and overhanging flange 29*b* resembling a mushroom. The smooth curvature of free end 29*a* allows coupling members 25 to penetrate a hole having a diameter less than overhanging flange 29*b*, with coupling members 25 being detachably insertable within the holes as the holes deform. Overhanging flanges 29*b* then secure coupling members 25 within the holes, and prevent coupling members 25 from easily reversing out of the holes due to the greater diameter of overhanging flanges 29*b* with respect to the holes. Accordingly, in an embodiment, coupling members 25 are insertable within opposing lateral apertures 15 disposed within one of flanges 14*a*, 14*b*. In an embodiment, coupling members 25 fit within slots disposed within one of flanges 14*a*, 14*b*, and lock into place by sliding within the slots, such that coupling members 25 cannot be removed without a manual force to translate coupling members 25 along the slots.

In an alternative embodiment, coupling members 25 extend from opposing portions 26, 27 on handle 24, such that a center axis of coupling members 25 is substantially parallel with a longitudinal axis of portions 26, 27. In this orientation, handle 24 is securable within the outer superior apertures 17 discussed above, in the embodiment in which one of flanges 14*a*, 14*b* include a plurality of superior apertures 17. As such, diametrically opposed handles 24 may be coupled to superior apertures 17 of opposing flanges 14*a*, 14*b*, providing gripping bodies 28 on opposing sides of container 10.

In alternative embodiments, rather than handle 24 including protruding coupling members 25 insertable within apertures, handle 24 could instead include an aperture. In this embodiment, flanges 14*a*, 14*b* include protruding coupling members extending therefrom, with the protruding coupling members being insertable within the apertures on handle 24. In an additional embodiment, one of flanges 14*a*, 14*b* could include a coupling member, with the other flange including an aperture, thereby providing an attachment between the flanges and the handles. Alternatively, rather than relying on the friction fit described above via the greater diameter of overhanging flange 29*b* as compared with lateral aperture 15, handle 24 could be coupled to one of flanges 14*a*, 14*b* via a bolt or screw that is insertable within flanges 14*a*, 14*b*, such as a toggle bolt. Further, handle 24 could include one or more spring pins insertable within lateral aperture 15, with the spring pins adapted to compress when inserted within lateral aperture 15, retaining handle 24 within flanges 14*a*, 14*b* via the force exerted by the spring pins against the surfaces defining lateral aperture 15.

Figure 7:
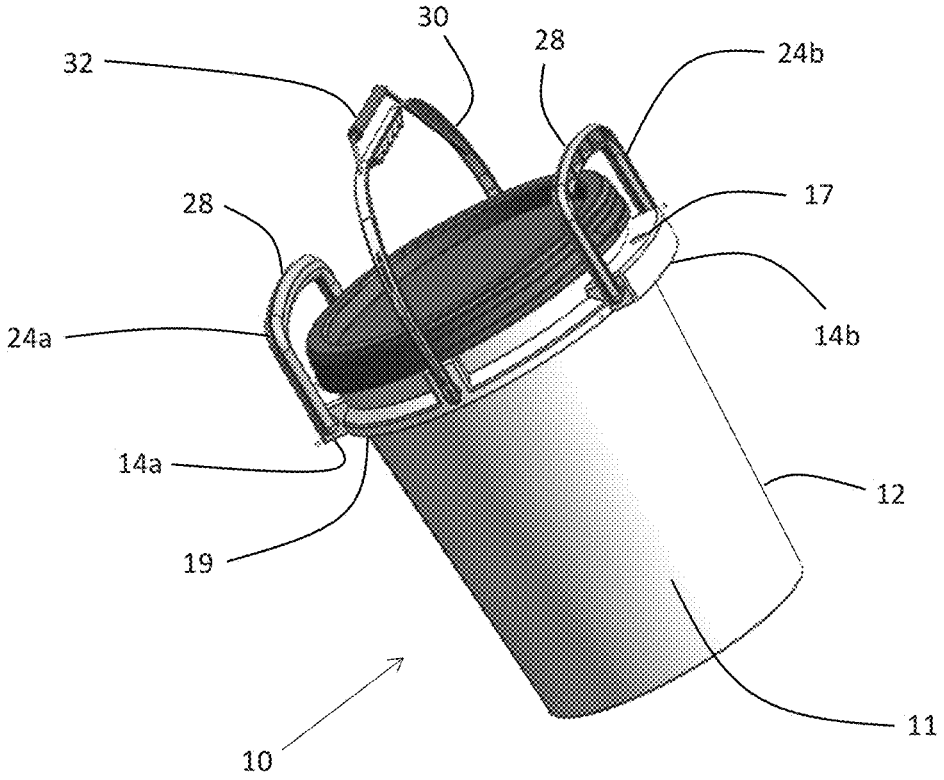
FIG. 7 is a perspective view of the container of FIG. 5 including a top handle.

As shown in FIG. 7, handles 24*a* and 24*b* are pivotably and detachably coupled to flanges 14*a* and 14*b*, respectively. As such, each of handles 24*a*, 24*b* are capable of forming a U-shape with respect to the flanges, or an upside-down U-shape with respect to the flanges. In the upside-down U-shape depicted in FIG. 7, each of the gripping bodies 28 is disposed further from lateral wall 11 than the distance between flanges 14*a*, 14*b* and lateral wall 11. As such, while base 20 is not shown in FIG. 7, flanges 14*a*, 14*b* are disposed between base 20 and gripping bodies 28 in the upside-down U-shape of FIG. 7.

FIG. 7 also shows the attachment of an additional handle, bail 30, which is similar to handles used in combination with prior art containers, such as paint cans and buckets. Bail 30 secures to opposing sides of container 10 via aperture 18 (the opposing aperture is not shown in the figures due to the perspective, but is separated by a diameter of annular member 19), which is shown in greater detail in FIGS. 1A, lB, 2, and 5, and is discussed above. The inclusion of bail 30 provides another handle for a user, allowing the user to transport container 10 by using only one hand. Bail 30 includes grip 32, which includes ridges sized and shaped to receive a user's fingers thereon; accordingly, grip 32 provides a more comfortable handle for bail 30 than handles commonly used in the prior art. In addition, if annular member 19 is separable from container 10, annular member 19 can be retrofit onto existing containers, with at least two apertures 18 providing attachment points for existing bail handles. Similar to lateral aperture 15 discussed above, aperture 18 can form a friction fit with bail 30, or the components can be secured by other mechanical fasteners, such as bolts, screws, toggle bolts, or spring pins.

Figure 8A:
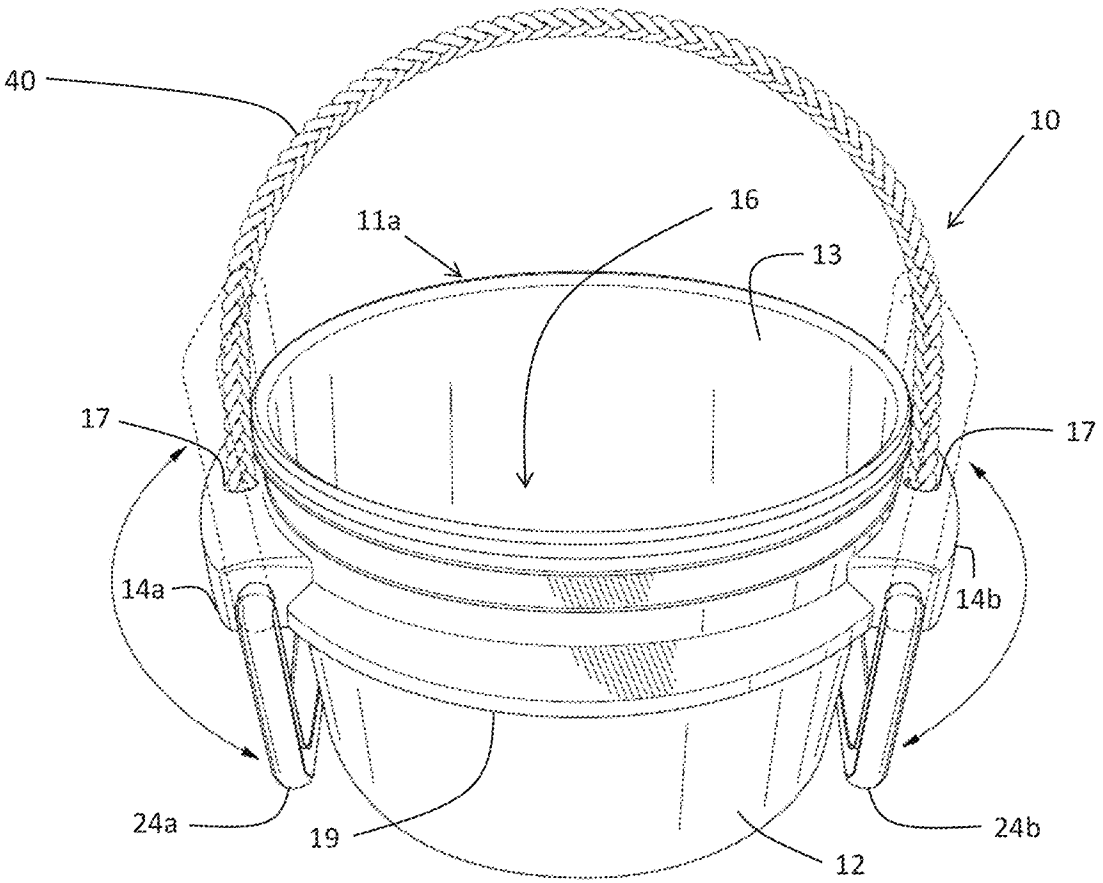
FIG. 8A is a perspective view of the container of FIG. 1 including a flexible handle secured to the set of flanges.

Turning now to FIG. 8A, superior aperture 17 provides an additional attachment point for flexible handle 40, which may be made of a length of rope, polymers such as nylon and rubber, flexible wood, and other materials having high tensile strength to allow elongation without breaking. Flexible handle 40 does not rely on a pivoting mechanism, thereby providing advantages in quiet settings, such as a fisher utilizing container 10 to store bait—in such a setting, noise from a pivoting handle is undesired, as it affects the behavior of the fish. In addition, such flexible materials are less likely to be damaged or deformed as a result of exposure to liquid, such as seawater—for example, a length of rope will not rust upon exposure to seawater, whereas a rigid, metal-based material would likely breakdown upon such exposure.

As shown in FIG. 8A, flexible handle 40 is a rope having opposing ends, insertable through and securable to each of the two superior apertures 17 disposed on opposing sides of container 10 (flexible handle 40 is interchangeably referred to as rope 40). As such, rope 40 forms a handle similar to bail 30 from FIG. 7, allowing a user to transport container 10 by holding rope 40. Because container 10 can include handles 24*a*, 24*b* in addition to rope 40 inserted within superior apertures 17, the distance between each superior aperture 17 and lateral wall 11 is less than the distance between each lateral aperture 15. As such, rope 40 coupled to one or more superior apertures 17 does not interfere with handles 24*a*, 24*b*, such as by exerting a force against handles 24*a*, 24*b* toward cavity 16 of container, such as would happen if lateral apertures 15 were disposed between superior apertures 17 and lateral wall 11.

Figure 8B:
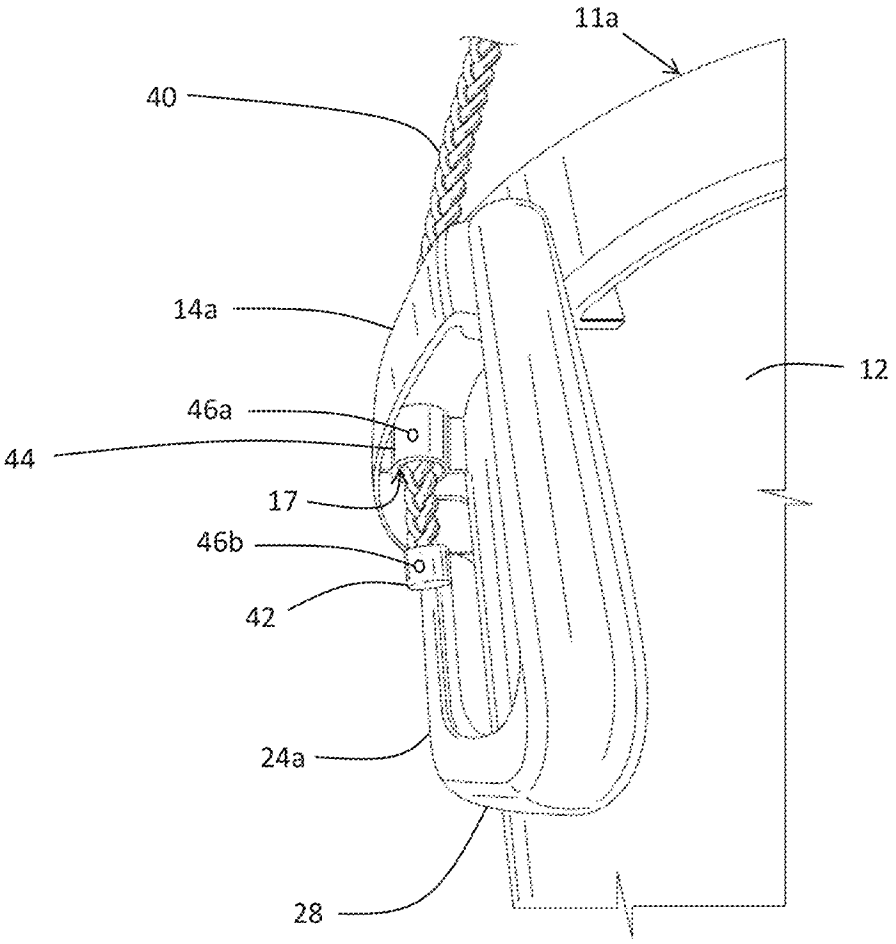
FIG. 8B is a perspective close-up view of the container of FIG. 8A, showing the underside of one of the flanges and the securing of the flexible handle therein.

Turning to FIG. 8B, the securing mechanism of rope 40 to container 10 is shown in greater detail. Each end of rope 40 includes end cap 42, with each end cap 42 being insertable within one of superior apertures 17. End caps 42 are formed of a material having a greater diameter than a diameter of rope 40, such that each end cap 42 surrounds an end of rope 40, and clamps against rope 40 to secure end cap 42 thereto. For example, a heat shrink material can be placed over the end of rope 40 and heated until it shrinks to surround the rope end, forming an end cap 42. Alternatively, as shown in FIG. 8B, superior aperture 17 is partially defined by wall 44, with wall 44 including aperture 46*a*. End cap 42 includes complementary aperture 46*b*. As such, end cap 42 is secured within aperture 17 via a pin inserted through apertures 46*a* and 46*b*, thereby preventing end cap 42 from being removed from within aperture 17.

In use, the various handle assemblies described above allow a user to comfortably, easily, and efficiently transport container 10 between locations. In addition, lip 22 provides a gripping location for a user's hand beneath base 20 of container 10, allowing a user to not only transport container 10, but overturn and empty the contents of container 10 with ease, and without forcing the user to grip specially formed handles. As such, the acts of transporting and emptying container 10 are made easier through the handle assemblies above.

Glossary of Claim Terms

Flange: is a graspable projection used for attachment to another object.

Flexible: capable of deforming without breaking.

Lateral aperture: is an aperture that is disposed within a side surface of an object, such that a center axis of the lateral aperture is perpendicular to a center axis of a superior aperture.

Lateral wall: is a sidewall of an object oriented along a longitudinal axis thereof.

Lip: is a graspable projecting edge of a container.

Longitudinal axis: is an axis that is parallel to the sidewalls of a container and perpendicular to a base of the container.

Superior aperture: is an aperture that is disposed within a top surface of an object, such that a center axis of the superior aperture is perpendicular to a center axis of a lateral aperture.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

What is claimed is:

1. A handle assembly comprising:

an annular member configured to be removably couplable to a movable container having a diameter, the annular member configured to have a diameter greater than the diameter of the container, such that the annular member is adapted to form a friction fit with the container;

a pair of lateral flanges diametrically disposed on the annular member, the pair of lateral flanges configured to be disposed proximate to a top end of the container, each lateral flange including a first end opposite a second end with a body disposed therebetween; and a lateral handle secured to each of the pair of lateral flanges, each lateral handle having a first portion opposite a second portion with a gripping body disposed therebetween.

2. The handle assembly of claim 1, further comprising a flexible third handle having a first end securable to one of the lateral flanges, and a second end securable to the other lateral flange, such that the third handle is configured to span across the diameter of the container.

3. The handle assembly of claim 1, further comprising a first lateral aperture disposed in the first end of each lateral flange, and a second lateral aperture disposed in the second end of each lateral flange, the lateral apertures providing attachment points for each of the lateral handles.

4. The handle assembly of claim 3, wherein the first and second portions of each lateral handle include a free end, the free ends being insertable within one of the first and second lateral apertures of each of the pair of lateral flanges.

5. The handle assembly of claim 1, further comprising a superior aperture disposed in an upper portion of the body of one of the pair of lateral flanges, the superior aperture configured to provide an attachment point for a flexible third handle.

6. The handle assembly of claim 5, further comprising a superior aperture disposed in an upper portion of the body of the diametrically opposed lateral flange, the superior aperture configured to provide an attachment point for a flexible third handle.

7. The handle assembly of claim 6, wherein each superior aperture is disposed proximate to an inner surface of the annular member.

8. The handle assembly of claim 1, further comprising:

a first lateral aperture disposed in the first end of each lateral flange, and a second lateral aperture disposed in the second end of each lateral flange; and a superior aperture disposed in an upper portion of the body of each of the pair of lateral flanges, wherein each superior aperture is disposed proximate to an inner wall of the annular member, and wherein each of the first and second lateral apertures is disposed between the inner wall of the annular member and an outer wall of the annular member, such that each superior aperture is configured to be disposed between the container and each of the lateral apertures.

9. A handle assembly comprising:

an annular member configured to be removably couplable to a movable container having a diameter, the annular member configured to have a diameter greater than the diameter of the container, such that the annular member is adapted to form a friction fit with the container;

a pair of lateral flanges diametrically disposed on the annular member, the pair of lateral flanges configured to be disposed proximate to a top end of the container, each lateral flange including a first end opposite a second end with a body disposed therebetween; and a plurality of apertures disposed within each of the pair of lateral flanges, the plurality of apertures configured to receive one or more handles therein.

10. The handle assembly of claim 9, wherein the plurality of apertures further comprises a first lateral aperture disposed in the first end of each lateral flange, and a second lateral aperture disposed in the second end of each lateral flange.

11. The handle assembly of claim 10, further comprising a lateral handle secured to each of the pair of flanges, each lateral handle having a first portion opposite a second portion with a gripping body disposed therebetween.

12. The handle assembly of claim 9, wherein the plurality of apertures further comprises a superior aperture disposed in an upper portion of the body of each of the pair of lateral flanges.

13. The handle assembly of claim 12, further comprising a flexible third handle having a first end securable to one of the superior apertures, and a second end securable to the other superior aperture.

14. The handle assembly of claim 9, wherein the plurality of apertures further comprises:

a first lateral aperture disposed in the first end of each lateral flange, and a second lateral aperture disposed in the second end of each lateral flange; and a superior aperture disposed in an upper portion of the body of each of the pair of lateral flanges, wherein each superior aperture is disposed proximate to an inner wall of the annular member, and wherein each of the first and second lateral apertures is disposed between the inner wall of the annular member and an outer wall of the annular member, such that each superior aperture is configured to be disposed between the container and each of the lateral apertures.

15. A handle assembly comprising:

an annular member configured to be removably couplable to a movable container having a diameter, the annular member configured to have a diameter greater than the diameter of the container, such that the annular member is adapted to form a friction fit with the container;

a pair of lateral flanges diametrically disposed on the annular member, the pair of lateral flanges configured to be disposed proximate to a top end of the container, each lateral flange including a first end opposite a second end with a body disposed therebetween;

a first lateral aperture disposed in the first end of each lateral flange, and a second lateral aperture disposed in the second end of each lateral flange;

a superior aperture disposed in an upper portion of the body of each of the pair of lateral flanges, wherein each superior aperture is disposed proximate to an inner wall of the annular member, and wherein each of the first and second lateral apertures is disposed between the inner wall of the annular member and an outer wall of the annular member, such that each superior aperture is configured to be disposed between the container and each of the lateral apertures;

a lateral handle secured to each of the pair of lateral flanges via each of the first lateral aperture and the second lateral aperture, each lateral handle having a first portion opposite a second portion with a gripping body disposed therebetween; and a flexible third handle having a first end securable to one of the superior apertures, and a second end securable to the other superior aperture.

* * * * *